United States Patent [19]

Mennesson

[11] 3,963,009

[45] June 15, 1976

[54] CARBURATION DEVICES FOR INTERNAL COMBUSTION ENGINES

[75] Inventor: Francois Mennesson, Nanterre, France

[73] Assignee: Societe Industrielle de Brevets et d'Etudes S.I.B.E., France

[22] Filed: Apr. 26, 1974

[21] Appl. No.: 464,443

[30] Foreign Application Priority Data

May 4, 1973 France ..... 73.16218

[52] U.S. Cl. ..... 123/119 D; 60/276; 261/44 R

[51] Int. Cl.[2] ..... F02M 7/00

[58] Field of Search ..... 123/124 B, 119 D, 119 R; 60/276; 261/50 A, 44 R

[56] References Cited

UNITED STATES PATENTS

| | | | |
|---|---|---|---|
| 2,389,797 | 11/1945 | MacNeil et al. | 60/276 |
| 3,342,463 | 9/1967 | Tasuka Date et al. | 261/50 A |
| 3,493,217 | 2/1970 | Farley | 261/44 R |
| 3,612,009 | 10/1971 | Kamazuka | 123/119 R |
| 3,764,120 | 10/1973 | Imai | 261/44 R |
| 3,796,200 | 3/1974 | Knapp | 60/276 |

*Primary Examiner*—Wendell E. Burns
*Assistant Examiner*—David D. Reynolds
*Attorney, Agent, or Firm*—Stevens, Davis, Miller & Mosher

[57] ABSTRACT

A carburetor has a main throttle and an auxiliary throttle which is automatically opened in proportion to the air flow in the induction pipe. Fuel is delivered to the induction pipe through a passage whose cross-section is metered in accordance with the position of the auxiliary throttle. The richness of the air-fuel mixture is automatically adjusted by a system comprising a probe which is sensitive to the conditions prevailing in the exhaust pipe. The system periodically opens an air path to the fuel passage and the duration of each opening period is automatically determined for a correct richness to be achieved.

8 Claims, 4 Drawing Figures to 32
FROM 23

CARBURATION DEVICES FOR INTERNAL COMBUSTION ENGINES

BACKGROUND AND SUMMARY OF THE INVENTION

The invention relates to carburation devices for internal combustion engines of the kind comprising an auxiliary throttle means in their induction pipe, upstream of a main throttle means actuated by the driver, the auxiliary throttle means automatically and progressively opening in proportion to the increase in the flow rate of air travelling through the pipe and actuating a metering device regulating the flow rate of fuel coming from a fuel source at substantially atmospheric pressue and flowing into the pipe due the the underpressure between the two throttle means, the air flow section metered by the auxiliary throttle means being substantially proportional to the fuel flow section metered by the metering means, and the air and fuel, which are thus introduced under the same pressure difference, from a mixture having a substantially constant richness during normal operation of the engine.

It is known that the standards for atmospheric pollution very strictly limit the richness of the air-fuel mixtures in carburetors, in order to reduce the proportion of polluting gases in the exhaust gases. To this end, it is already known to provide a carburation device having a servo-motor which permanently adjusts the cross-section of the orifices supplying the fuel and/or air of the mixture, the servo-motor being actuated in accordance with the characteristics of the exhaust gases in an attempt to control the richness of the mixture automatically. A system using a servo-motor for metering the orifices is however quite expensive.

It is an object of the invention to provide a carburation device, wherein the richness of the air-fuel mixture is automatically adjusted and which uses simple, rugged and relatively inexpensive means for that purpose.

To this end, there is provided a carburation device having means for adjusting the richness of the mixture in response to the characteristics of the engine exhaust gases, said means comprising a solenoid valve which is actuated periodically and for an overall period of time which is adjusted in dependence on said characteristics thereby alternately opening and closing means delivering air to a fuel circuit connecting the fuel source to the induction pipe.

The invention will be more clearly understood from the following description and accompanying drawings, both of which relate to particular embodiments, given by way of examples.

SHORT DESCRIPTION OF THE DRAWINGS

DESCRIPTION OF PREFERRED EMBODIMENTS

Figures 1, 1A:
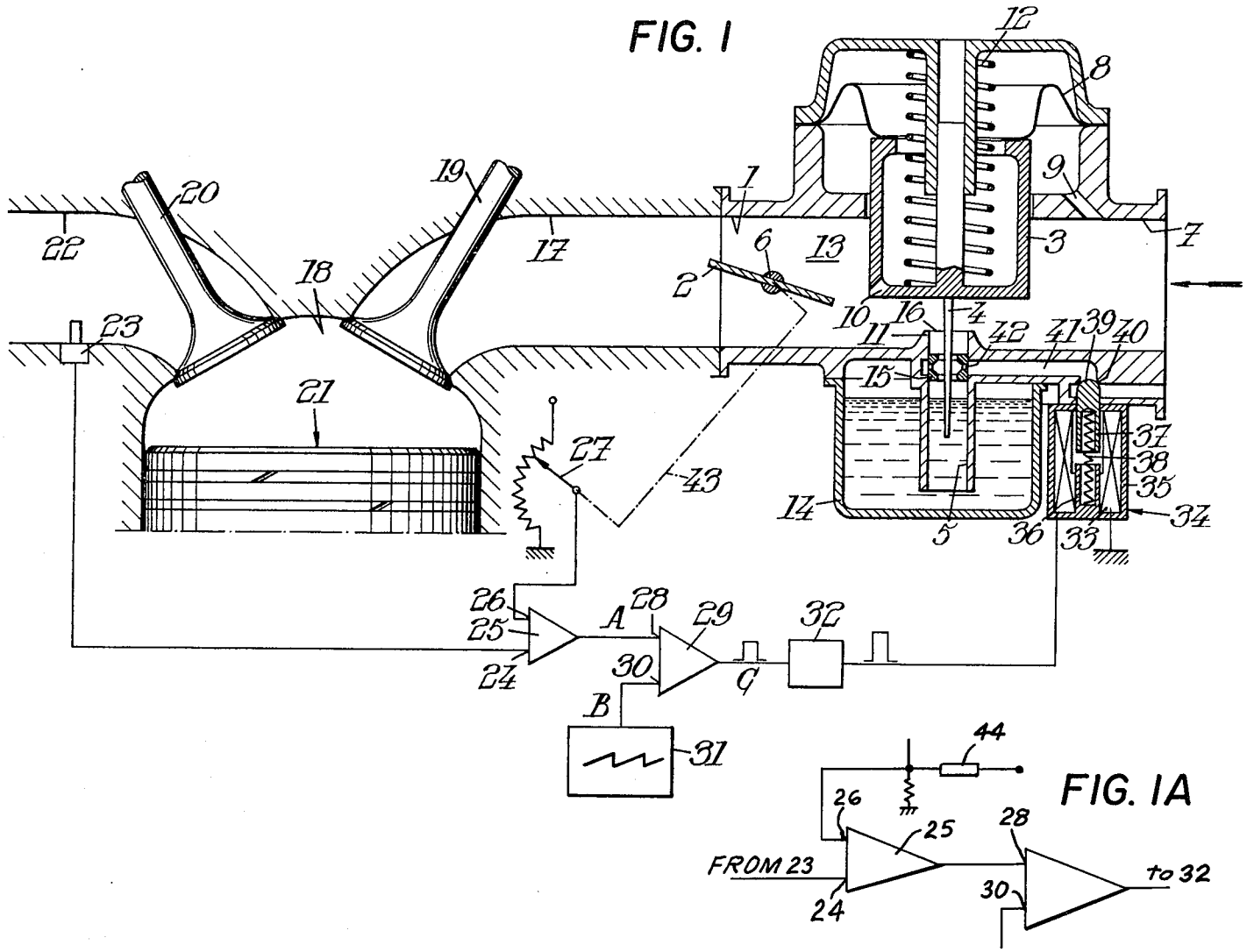
FIG. 1 is a simplified diagram of an embodiment of a device according to the invention.
FIG. 1A is an illustration of a modification of a portion of FIG. 1.

The carburation device may have any appropriate construction. It comprises an auxiliary throttle 3 in its induction pipe 1, upstream of a main throttle 2 actuated by the driver (via a linkage, not shown). The throttle 3 is associated with actuating means which open it automatically and progressively in proportion to the increase in the flow rate of air through the pipe (in the direction of the arrow in FIG. 1. The throttle 3 actuates metering means 4 adjusting the flow rate of fuel, which is sucked into pipe 1 via a supply pipe 5 terminating in a place where the underpressure is substantially the same as between the throttle means 2 and 3.

In the illustrated embodiment, the throttle 2 is a butterfly valve keyed on a rotating shaft 6. The auxiliary throttle 3 is disposed in an air intake 7 which is at the inlet of pipe 1 and is protected by an air filter (not shown) and can be a sliding piston connected to a diaphragm 8, one side of which is subjected via orifice 9 to the pressure in air intake 7 and the other side of which is subjected via an orifice 10 through the piston wall to the underpressure (below atmospheric pressure) which prevails between the two throttles 2, 3. The wall of pipe 1 has an annular protuberance 11 which, opposite piston 3, has a flat surface parallel to the end of the piston. The pressure differential exerted on diaphragm 8 tends to move the piston 3 upwardly against the action of a return device such as a counterweight or at least one spring 12. Piston 3 may be replaced by any other equivalent throttle (e.g. an eccentric flap keyed on a rotating shaft or a spring loaded valve).

It is known that the throttle 3, which cooperates with means 2 to bound a chamber 13 in pipe 1, is designed to maintain an underpressure in chamber 13 which is substantially constant or which at least varies with the air flow rate in accordance with a predetermined law. There is provided a suitable fuel source, such as a constant-level tank 14 vented at atmospheric pressure, preferably by a pipe (not shown) opening in the air intake 7. Fuel is sucked through a jet 15 into the supply pipe 5. The metering device 4 may be a needle whose cross-section varies along its length and which is operatively connected to throttle 3 (or which is secured thereto if the throttle 3 is a sliding piston), so that the movements of throttle 3 result in a variation in the free annular cross-section of jet 15.

Accordingly, fuel is metered in dependence on the flow rate of air through pipe 1, and is sucked via pipe 5 into pipe 1, arriving directly via an orifice 16 forming the downstream end of pipe 5. Pipe 1 is connected to the intake manifold 17 of the internal combustion engine, one cylinder 18 of which is diagrammatically shown and comprises an inlet valve 19, an exhaust valve 20, a piston 21 and an exhaust pipe 22.

A pickup probe 23 is disposed in exhaust pipe 22 and delivers an electric voltage signal representative of the richness of the air-fuel mixture supplied to the engine. The voltage signal can e.g. depend on the oxygen or carbon monoxide content of the exhaust gases. The voltage signal which, in the example given, is of decreasing amplitude when the richness of the mixture increases, is conveyed to an input 24 of a comparator-amplifier (or differential amplifier) 25. The other input 26 of amplifier 25 is connected to a potentiometer 27 which delivers a reference voltage which will be assumed to be invariable for simplicity. Amplifier 25 delivers an output signal proportional to the difference between the two inputs signals; the output signal is conveyed to an input 28 of a comparator 29. The other input 30 of comparator 29 is connected to a saw-tooth signal generator 31. The output signal of comparator 29 is amplified by a power amplifier 32 and the signal from amplifier 32 is conveyed to the coil 33 of a solenoid valve 34. Valve 34 comprises a magnetic circuit 35, a central core 36 and a plunger 37 actuated so that, when current flows in coil 33, plunger 37 is attracted to core 36 against the action of a return spring 38. Spring 38 tends to sealingly apply the outer end 39 of plunger 37 against a seat 40, thus closing a duct 41 which, when open, supplies air at approximately atmospheric pressure to the center portion of jet 15 via radial orifices 42 in jet 15. Pipe 41 can be protected by the same filter as the air intake 7.

Figure 2:
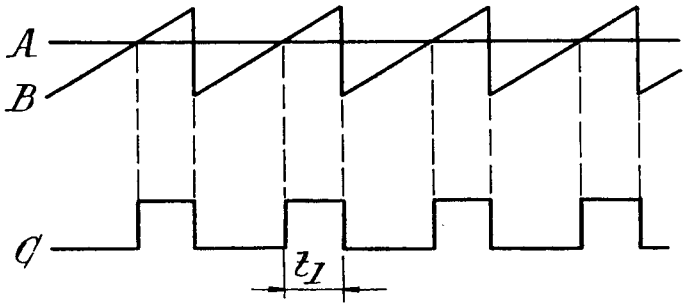
FIGS. 2 and 3 show voltage curves corresponding to certain places on the diagram in FIG. 1.

Operation of the carburation device is as follows: assuming firstly that the carburetor delivers an air-fuel mixture of suitable richness, pickup 23 delivers a voltage equal to the reference voltage given by potentiometer 27; referring to FIG. 2, the voltage A (output signal of differential amplifier 25) is therefore zero since the voltages at the two inputs 26, 24 are equal. Voltage A is compared with the voltage signal of the saw-tooth signal generator 31 in the comparator 39. The comparator is of a type which delivers a square-wave signal C of duration $t_1$ which begins when voltage A and voltage B (from generator 31) are equal and ends at each steep edge of the sawtooth signal B. The pulses of duration $t_1$ are amplified and conveyed to the solenoid valve coil 33. Consequently, plunger 37 alternately opens and closes pipe 41, supplying air via the radial orifices 42 into the calibrated jet 15.

Preferably, the frequency of the pulses of duration $t_1$ is selected sufficiently high for the air flow arising in jet 15 to be only slightly pulsed; this purpose is achieved if the volume of pipe 41 is high compared with the flow cross-section of orifices 42.

It can be seen that, when the opening time of the solenoid valve increases, there is a corresponding increase in the air flow rate in jet 15 and a corresponding decrease in the fuel flow rate therein.

Figure 3:
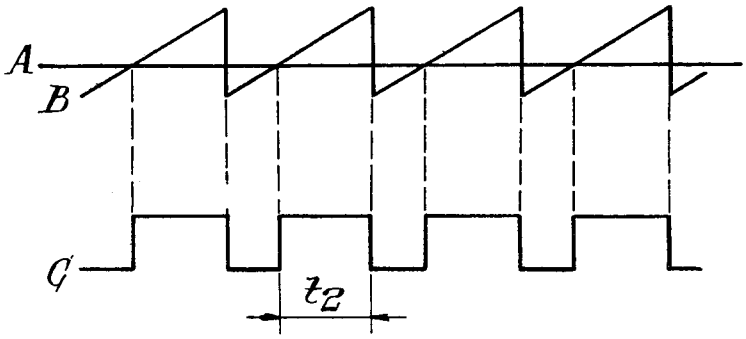

Assuming now that, for any reason (e.g. a drop in atmospheric pressure or an increase in the external temperature) there is an increase in the richness of the fuel-air mixture supplied by the carburetor. In that case, the voltage supplied by pickup 23 becomes less than the reference voltage of potentiometer 27. Consequently, voltage A decreases, and the signals obtained are as shown in FIG. 3. As can be seen, comparator 29 delivers a square-wave signal C whose duration $t_2$ is greater than $t_1$. As a result, valve 34 is open for longer periods and the average flow rate of air (fuel weight per time unit) into orifices 42 increases, thus reducing the richness of the mixture supplied to the engine until it is at the correct value.

There is thus obtained a device adapted to maintain the richness of the mixture to a carburetor at a substantially constant value, irrespective of perturbations, and which is simple and rugged, since the corrective effect makes use of a valve which is operated between its fully closed and fully open position only.

The invention is not limited to the particular embodiment which has been described but includes, inter alia, devices where the richness of the air-fuel mixture should be adjusted in accordance with one or more parameters depending on the engine operating characteristics. More particularly, if it is desired to vary the richness in dependence on the engine load, potentiometer 27 can be actuated by the linkage of the butterfly-valve 2, via a connection schematically shown as 43 in FIG. 1. Similarly, the richness control can be modified in dependence on the temperature (of the engine or of the surrounding air) by varying the reference voltage in dependence on the temperature. Such a modified embodiment is illustrated in schematic form on FIG. 1A, in which the elements corresponding to those of FIG. 1 are designated by the same reference numeral. The input terminal 26 of amplifier 25 is connected to a reference voltage which depends on the temperature, using for instance a resistor 44 which is temperature dependent.

In another modified embodiment, instead of maintaining the pulses energizing valve 34 at a constant frequency and varying the duration thereof, the duration can be kept constant and the frequency can be varied, thus likewise varying the total duration of energization per time unit.

I claim:

1. A carburation device for internal combustion engines, comprising: an induction pipe; driver actuated main throttle means in said pipe; auxiliary throttle means located in said induction pipe upstream of said main throttle means and which automatically and progressively open in proportion to the increase in the flow rate of air in said induction pipe; a source of fuel at substantially atmospheric pressure; conduit means for delivery of fuel from said source to a portion of said induction pipe between said main throttle means and auxiliary throttle means; metering means operatively connected to said auxiliary throttle means and metering the flow rate of fuel in said conduit means wherein an air flow section determined by the auxiliary throttle means is in proportion to a fuel flow section metered by said metering means and the mixture of air and fuel delivered to said induction pipe has a substantially constant richness during normal operation; a solenoid valve which, in energized conditions, fully opens an air path to said fuel conduit means and under de-energized conditions fully closes the path; and means responsive to a parameter of the engine exhaust gas and which repetitively energizes the solenoid valve for a fraction of the repetition period which is such that the total time during which the valve is fully open during a predetermined time duration is adjusted in dependence on said exhaust gas parameter.

2. A carburation device according to claim 1, wherein said means for energizing the solenoid valve comprises a source of reference voltage, a source of voltage varied in proportion to said parameter of the exhaust gas, a differential amplifier whose inputs receive signals from the two voltage sources respectively and whose output is connected to one input of a comparator, a saw-tooth signal generator whose output is connected to the other input of the comparator, and an amplifier whose input is connected to the comparator output and whose output delivers a signal energizing the solenoid valve.

3. A carburation device according to claim 2, wherein the reference voltage source is constructed and arranged to supply a voltage which is a function of at least one parameter depending on the engine operating characteristics.

4. A carburation device according to claim 3, wherein the parameter is the engine load.

5. A carburation device according to claim 4, wherein said reference voltage is delivered by a circuit having an adjustable resistor operatively connected to the main throttle means.

6. A carburation device according to claim 3, wherein the said engine parameter is the temperature.

7. A carburation device according to claim 1 wherein said solenoid valve includes a movable closure member which moves to open and close the air path.

8. A carburation device according to claim 1 wherein said closure member is a plunger.

* * * * *